US010404016B2

(12) United States Patent
Chen et al.

(10) Patent No.: US 10,404,016 B2
(45) Date of Patent: Sep. 3, 2019

(54) ELECTRIC CONNECTION ASSEMBLY

(71) Applicant: Tyco Electronics (Shanghai) Co. Ltd., Shanghai (CN)

(72) Inventors: Shu Chen, Shanghai (CN); Xian Li, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 15/704,430

(22) Filed: Sep. 14, 2017

(65) Prior Publication Data

US 2018/0076574 A1 Mar. 15, 2018

(30) Foreign Application Priority Data

Sep. 14, 2016 (CN) ..... 2016 2 1056572 U

(51) Int. Cl.
*H01R 13/68* (2011.01)
*H01R 13/684* (2011.01)
*H01H 85/54* (2006.01)

(52) U.S. Cl.
CPC ..... *H01R 13/684* (2013.01); *H01H 85/54* (2013.01)

(58) Field of Classification Search
CPC ..... H01R 13/68; H01H 85/2035; H01H 85/2045; H01H 85/205; H01H 2085/208
USPC ..... 439/620.26, 0.3
See application file for complete search history.

(56) References Cited

U.S. PATENT DOCUMENTS 5,429,530 A * 7/1995 Zander ..... H01R 4/2429 439/411
5,618,209 A * 4/1997 Lin ..... H01H 85/205 439/620.26
5,700,165 A * 12/1997 Harris ..... H01H 9/085 439/188
5,820,413 A * 10/1998 Yamada ..... H01H 85/201 439/620.26
6,030,257 A * 2/2000 Furuya ..... H01H 85/2045 439/620.26
6,168,470 B1 * 1/2001 Ikeda ..... H01M 2/206 439/620.08
6,299,466 B1 * 10/2001 Bolen ..... B60R 16/027 439/164
8,242,874 B2 * 8/2012 Pavlovic ..... H01H 85/153 337/187
2013/0187601 A1 * 7/2013 Petrie ..... H01R 13/635 320/109

* cited by examiner

*Primary Examiner* — Hien D Vu
(74) *Attorney, Agent, or Firm* — Barley Snyder

(57) ABSTRACT

An electric connection assembly comprises a connector, a first wire, a second wire, and a fuse. The connector has a housing, a first conductive contact disposed in the housing, and a second conductive contact disposed in the housing. The first wire has a first end electrically connected to the first conductive contact and an opposite second end electrically connected to a first electrode of a load. The second wire has a first end electrically connected to the second conductive contact and an opposite second end electrically connected to a second electrode of the load. The fuse is connected in series with the second wire.

13 Claims, 2 Drawing Sheets

ELECTRIC CONNECTION ASSEMBLY

CROSS-REFERENCE TO RELATED APPLICATION

This application claims the benefit of the filing date under 35 U.S.C. § 119(a)-(d) of Chinese Patent Application No. 201621056572.2, filed on Sep. 14, 2016.

FIELD OF THE INVENTION

The present invention relates to an electric connection assembly and, more particularly, to an electric connection assembly electrically connected between a power supply device and a load.

BACKGROUND

In the prior art, one power supply system is generally used to simultaneously supply power to a plurality of separate loads. The plurality of separate loads are electrically connected to a plurality of power connectors through a single mainboard, and are electrically connected to busbars of the power supply system through the plurality of power connectors.

Due to different working conditions for each load, an overload may occur in one of the plurality of separate loads. An overload in one load raises the temperature of the entire load system. The mainboard may burn out if the temperature is too high, which could lead to paralysis of the entire load system, fire, and other security incidents.

SUMMARY

An electric connection assembly according to the invention comprises a connector, a first wire, a second wire, and a fuse. The connector has a housing, a first conductive contact disposed in the housing, and a second conductive contact disposed in the housing. The first wire has a first end electrically connected to the first conductive contact and an opposite second end electrically connected to a first electrode of a load. The second wire has a first end electrically connected to the second conductive contact and an opposite second end electrically connected to a second electrode of the load. The fuse is connected in series with the second wire.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
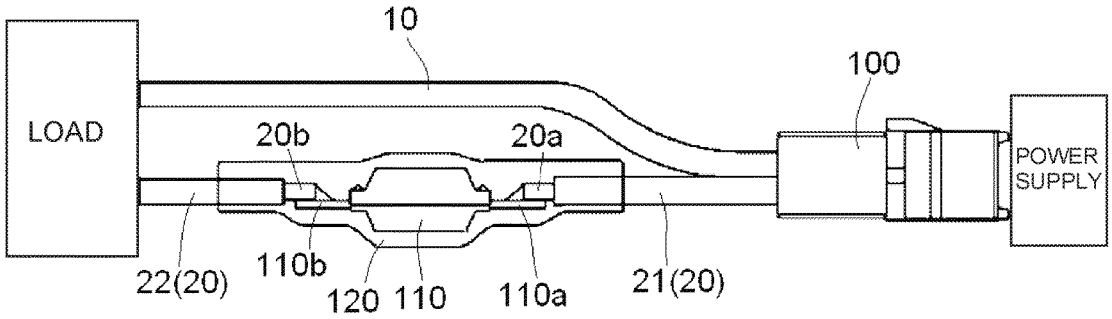
FIG. 1 is a sectional top view of an electric connection assembly according to an embodiment of the invention.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will be thorough and complete and will fully convey the concept of the invention to those skilled in the art.

An electric connection assembly according to an embodiment of the invention is shown in FIG. 1. The electric connection assembly includes a connector 100, a first wire 10, a second wire 20, a fuse 110, and a protective sleeve 120.

The connector 100, as shown in FIG. 1, has a housing, a first conductive contact, and a second conductive contact disposed in the housing. A first end of the first wire 10 is electrically connected to the first conductive contact of the connector 100 and an opposite second end of the first wire 10 is electrically connected to a first electrode of a load directly or through a circuit board. A first end of the second wire 20 is electrically connected to the second conductive contact of the connector 100, and an opposite second end of the second wire 20 is electrically connected to a second electrode of the load directly or through the circuit board. The connector 100 is connectable to a power supply device such that the electric connection assembly electrically connects the power supply device and the load.

In the embodiment shown in FIG. 1, the first wire 10 is electrically connected to a positive electrode of the load and the second wire 20 is electrically connected to a negative electrode of the load. In other embodiments, the first wire 10 may be electrically connected to the negative electrode of the load and the second wire 20 may be electrically connected to the positive electrode of the load.

The fuse 110, as shown in FIG. 1, is connected in series with the second wire 20. The fuse 110 is immediately broken once the load is overloaded to prevent a temperature of a load system from rising; avoiding fire and other security incidents. The second wire 20 has a first portion 21 connected to a first end 110*a* of the fuse 110 and a second portion 22 connected to an opposite second end 110*b* of the fuse 110. A conductor 20*a* of the first portion 21 is welded onto the first end 110*a* of the fuse 110 and a conductor 20*b* of the second portion 22 is welded onto the second end 110*b* of the fuse 110.

As shown in FIG. 1, the fuse 110 is fully disposed within the protective sleeve 120. A first end of the protective sleeve 120 is tightly mounted on the first portion 21 of the second wire 20 and an opposite second end of the protective sleeve 120 is tightly mounted on the second portion 22 of the second wire 20. The fuse 110 is thus received and sealed in the protective sleeve 120.

Figure 2:
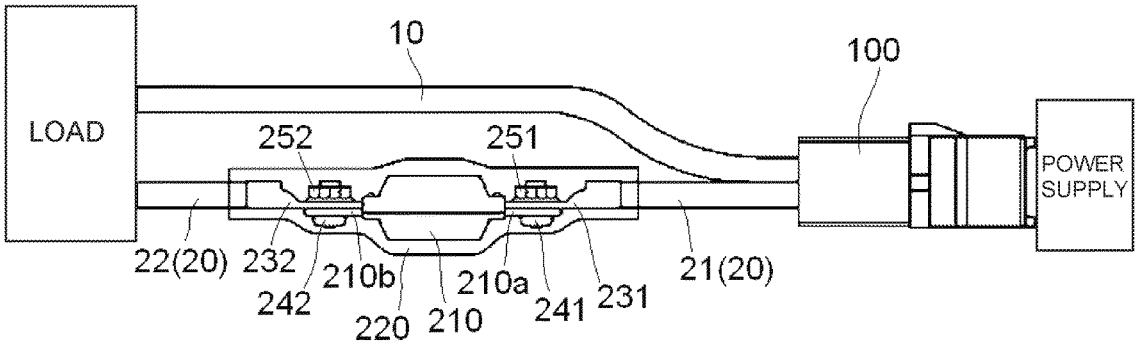
FIG. 2 is a sectional top view of an electric connection assembly according to another embodiment of the invention.

An electric connection assembly according to another embodiment of the invention is shown in FIG. 2. The electric connection assembly of FIG. 2 includes a connector 100, a first wire 10, a second wire 20, a fuse 210, a protective sleeve 220, a first connection terminal 231, and a second connection terminal 232. Like reference numbers indicate like elements and only the differences from the embodiment shown in FIG. 1 will be described in detail herein.

The first portion 21 of the second wire 20 is connected to a first end 210*a* of the fuse 210 and the second portion 22 of the second wire 20 is connected to an opposite second end 210*b* of the fuse 210. A first end of the first connection terminal 231 is crimped onto the conductor 20*a* of the first portion 21 and an opposite second end of the first connection terminal 231 is detachably connected to the first end 210*a* of the fuse 210. A first end of the second connection terminal 232 is crimped onto the conductor 20*b* of the second portion 22 and an opposite second end is electrically connected to the second end 210*b* of the fuse 210.

As shown in FIG. 2, the second end of the first connection terminal 231 is detachably connected to the first end 210*a* of the fuse 210 through a first fastener 241, 251. The second end of the second connection terminal 232 is detachably connected to the second end 210*b* of the fuse 210 through a second fastener 242, 252. The first fastener 241, 251 includes a first screw 241 extending through the second end of the first connection terminal 231 and the first end 210*a* of the fuse 210, and a first fastening nut 251 screwed on the first screw 241. The second fastener 242, 252 includes a second screw 242 extending through the second end of the second connection terminal 232 and the second end 210*b* of the fuse 210, and a second fastening nut 252 screwed on the second screw 242.

As shown in FIG. 2, the fuse 210 is fully disposed within the protective sleeve 220. A first end of the protective sleeve 220 is tightly mounted on the first portion 21 of the second wire 20 and an opposite second end of the protective sleeve 220 is tightly mounted on the second portion 22 of the second wire 20. The fuse 210 is thus received and sealed in the protective sleeve 220.

Figure 3:
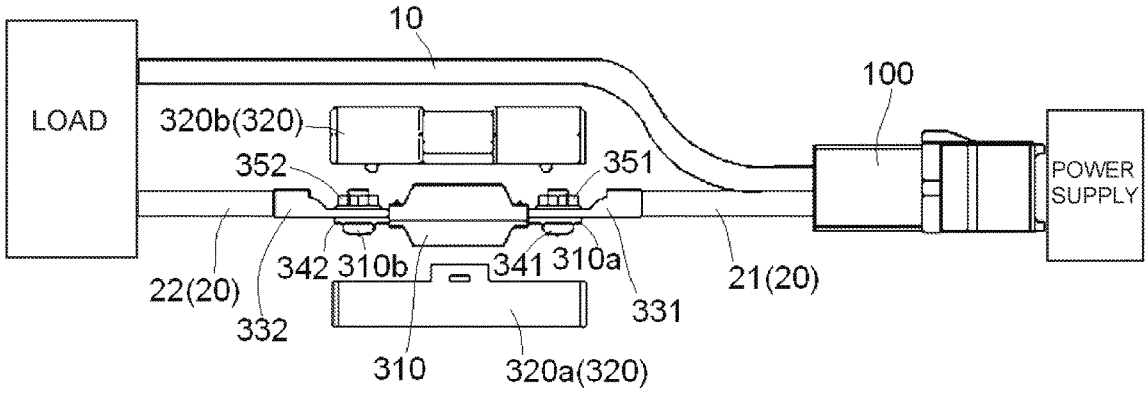
FIG. 3 is a sectional top view of an electric connection assembly according to another embodiment of the invention.

An electric connection assembly according to another embodiment of the invention is shown in FIG. 3. The electric connection assembly of FIG. 3 includes a connector 100, a first wire 10, a second wire 20, a fuse 310, a protective housing 320, a first connection terminal 331, and a second connection terminal 332. Like reference numbers indicate like elements and only the differences from the embodiments shown in FIGS. 1 and 2 will be described in detail herein.

The first portion 21 of the second wire 20 is connected to a first end 310*a* of the fuse 310 and the second portion 22 of the second wire 20 is connected to an opposite second end 310*b* of the fuse 310. A first end of the first connection terminal 331 is crimped onto the conductor 20*a* of the first portion 21 and an opposite second end of the first connection terminal 331 is detachably connected to the first end 310*a* of the fuse 310. A first end of the second connection terminal 332 is crimped onto the conductor 20*b* of the second portion 22 and an opposite second end of the second connection terminal 332 is electrically connected to the second end 310*b* of the fuse 310.

As shown in FIG. 3, the second end of the first connection terminal 331 is detachably connected to the first end 310*a* of the fuse 310 through a first fastener 341, 351. The second end of the second connection terminal 332 is detachably connected to the second end 310*b* of the fuse 310 through a second fastener 342, 352. The first fastener 341, 351 includes a first screw 341 extending through the second end of the first connection terminal 331 and the first end 310*a* of the fuse 310, and a first fastening nut 351 screwed on the first screw 341. The second fastener 342, 352 includes a second screw 342 extending through the second end of the second connection terminal 332 and the second end 310*b* of the fuse 310, and a second fastening nut 352 screwed on the second screw 342.

As shown in FIG. 3, the fuse 310 is fully disposed within the protective housing 320. The protective housing 320 includes a first half housing 320*a* and a second half housing 320*b* adapted to be detachably assembled with each other in a snap-fit manner; in this way, the protective housing 320 can be quickly opened and closed to facilitate replacement of the fuse 310.

What is claimed is:

1. An electric connection assembly, comprising:

a connector having a housing connected to a first wire and a second wire, a first conductive contact disposed in the housing, and a second conductive contact disposed in the housing;

the first wire having a first end electrically connected to the first conductive contact in the housing and an opposite second end electrically connected to a first electrode of a load;

the second wire having a first end electrically connected to the second conductive contact in the housing and an opposite second end electrically connected to a second electrode of the load; and a fuse connected in series with the second wire.

2. The electric connection assembly of claim 1, wherein the second wire has a first portion connected to a first end of the fuse and a second portion connected to an opposite second end of the fuse.

3. The electric connection assembly of claim 2, wherein a conductor of the first portion is welded onto the first end of the fuse and a conductor of the second portion is welded onto the second end of the fuse.

4. The electric connection assembly of claim 2, further comprising:

a first connection terminal having a first end crimped onto a conductor of the first portion and an opposite second end detachably connected to the first end of the fuse; and a second connection terminal having a first end crimped onto a conductor of the second portion and an opposite second end electrically connected to the second end of the fuse.

5. The electric connection assembly of claim 4, wherein the second end of the first connection terminal is detachably connected to the first end of the fuse through a first fastener and the second end of the second connection terminal is detachably connected to the second end of the fuse through a second fastener.

6. The electric connection assembly of claim 5, wherein the first fastener has a first screw extending through the second end of the first connection terminal and the first end of the fuse, and a first fastening nut screwed on the first screw.

7. The electric connection assembly of claim 6, wherein the second fastener has a second screw extending through the second end of the second connection terminal and the second end of the fuse, and a second fastening nut screwed on the second screw.

8. The electric connection assembly of claim 4, further comprising a protective housing in which the fuse is disposed.

9. The electric connection assembly of claim 8, wherein a first end of the protective housing is mounted on the first portion and an opposite second end of the protective housing is mounted on the second portion.

10. The electric connection assembly of claim 8, wherein the protective housing includes a first half housing and a second half housing adapted to be detachably assembled with each other.

11. The electric connection assembly of claim 10, wherein the first half housing and the second half housing are detachably assembled with each other in a snap-fit manner.

12. The electric connection assembly of claim 1, wherein the connector is connectable to a power supply device to electrically connect the power supply device and the load.

13. The electric connection assembly of claim 1, wherein the first electrode is a positive electrode and the second electrode is a negative electrode.

* * * * *